United States Patent [19]

Elliott et al.

[11] 4,377,208

[45] Mar. 22, 1983

[54] RECOVERY OF NATURAL GAS FROM DEEP BRINES

[76] Inventors: Guy R. B. Elliott; Nicholas E. Vanderborgh, both of Los Alamos; Milton W. McDaniel, Cimarron, all of N. Mex.

[21] Appl. No.: 211,138

[22] Filed: Nov. 28, 1980

[51] Int. Cl.[3] ..... E21B 43/25; E21B 43/38

[52] U.S. Cl. ..... 166/265; 166/54.1; 166/105.5; 166/311; 166/370

[58] Field of Search ..... 166/54.1, 105.5, 265, 166/305 D, 311, 369, 370, 371; 60/641, 641.2, 641.3, 641.4

[56] References Cited

U.S. PATENT DOCUMENTS

| | | | |
|---|---|---|---|
| 2,018,700 | 10/1935 | Blau | 166/369 |
| 3,782,468 | 1/1974 | Kuwada | 166/265 X |
| 4,131,161 | 12/1978 | Lacquement | 166/265 |
| 4,149,596 | 4/1979 | Richardson et al. | 166/370 |
| 4,149,598 | 4/1979 | Christian | 166/370 |
| 4,296,810 | 10/1981 | Price | 166/265 |

OTHER PUBLICATIONS

*Petroleum Production Handbook,* Editors T. C. Frick and R. W. Taylor, Chapter 6, "Hydraulic Pumps", by C. J. Coberly and F. B. Brown; Chapter 31, Wellbore Hydraulics, by J. K. Welchon, A. F. Bertuzzi, and F. H. Poettman.

"The Status of Dissolved Gas in Japan," by S. S. Marsden, *Petroleum Engineer,* Jun. 1980, pp. 23–34.

*Primary Examiner*—Stephen J. Novosad
*Assistant Examiner*—George A. Suchfield
*Attorney, Agent, or Firm*—Paul D. Gaetjens

[57] ABSTRACT

A method is described for circulating hydrostatically pressured or geopressured brines so that dissolved methane in the brines can be recovered within the wellpipe. All processes take place downhole or in the surrounding briny formations, and the circulation is powered wholly or in large part by the pressure on the brine and natural compressive forces in the formation.

7 Claims, 5 Drawing Figures

RECOVERY OF NATURAL GAS FROM DEEP BRINES

BACKGROUND OF THE INVENTION

1. Field of the Invention

The methane-containing, sedimentary formations are drilled to great depths, into or in search of gas caps which will deliver natural gas (primarily methane) to the surface. These wells are capped off and abandoned when the gas cap is exhausted or if no gas cap is located. With deep wells, e.g., at depths greater than 10,000 feet, this practice leaves unrecovered what is usually the major fraction of the natural gas penetrated. Specifically, it leaves behind (a) natural gas dissolved in the hot, high-pressured brine and (b) gas trapped as small bubbles in the pores of the host formation. If the dissolved gas is extracted in some way from its solution in the brine, then the entrapped bubbles will resupply the depleted gas dissolved in the brine, again creating a solution of natural gas in brine. In fact, sampling of the gas solutions in brine from actual wells confirms that the brine is indeed saturated with natural gas, consistent with the presence of both dissolved gas and bubbles in two thermodynamically different phases. Gas which is dissolved or entrapped in small pores is not considered recoverable on a commercial basis.

In explaining this invention it is useful to consider two representative sets of conditions downhole, one involving brine at normal hydrostatic pressures and the other dealing with brine at abnormal pressures because of some additional lithostatic pressure, i.e., geopressured. Under each set of conditions the natural gas is recoverable, but the environmental problems are greater for the geopressured case.

First, for the hydrostatically pressured case, assume the following conditions: the formation containing the brine has a porosity of 25% and a permeability of one darcy, the hydrostatic pressure is about 0.465 psia per foot of depth, so a well drilled to 15,200 feet has a bottom-hole pressure (BHP) of 7,065 psia. The temperature is 300° F., and at this temperature the pressure of saturated steam over the brine is about 65 psia. In addition, the brine is saturated with natural gas so that its partial pressure of 7,000 psia plus that of the steam just equals the 7,065 psia BHP. The methane concentration to achieve saturation is 38 standard cubic feet (SCF) per bbl of brine at bottom-hole conditions. The brine is saturated with the solids making up the host formation, and additional solubility of $CaCO_3$ and other carbonates results from the presence of dissolved $CO_2$ which adds $Ca(HCO_3)_2$ to the solution. Near-saturation quantities of $CaSO_4$ and other sulfates may be present even though the solids do not exist in the formation. NaCl and other dissolved chlorides are not of great importance for the present analysis. Temperatures and pressures decrease at depths less than those at the bottom of the wellpipe, and the pressures of steam and methane fall to near zero at ground level or the ocean surface. In a theoretical sense these conditions are unstable because the hot brine could in principle move to a lower pressure region and discharge methane and steam. Here the hot brine and gases which could no longer be contained by the hydrostatic pressure head would rush up the wellpipe in a continuing action much like the action of a coffee percolator or geyser. In practice there is a vanishingly small likelihood that the upward flow of brine would initiate itself; if, however, the system is designed properly, and if the circulation is initiated, then this tendency to release methane can be used to circulate brines so that their dissolved methane can be removed in a special type of stripper. The potential to release steam must be suppressed because steam vaporization may lead to solid precipitation and plugging of the wellpipe. This invention describes a method to initiate and continue the circulation while suppressing the steam vaporization and wellpipe plugging.

The work used to circulate the brine is derived from two in situ sources, and these in situ sources of work can be supplemented from external sources such as engines at the earth or water surface. First, in situ, simultaneous and coupled release of virgin brine and reinjection of spent brine back into the formation are used to balance the release and injection forces, and, second, in situ, additional energy to overcome frictional forces is available from the release of methane and limited amounts of steam as pressure is reduced, and the expansion of these gases provides a fluid which can do useful work downhole. If the methane pressure is dropped from 7,000 psia to 14.7 psia (atmospheric pressure), then 38 SCF of natural gas per bbl of brine will be released. About 7.8% of the brine also will boil off before the temperature drops from 300° F. to 212° F. and atmospheric pressure is reached. This alteration of the brine will result in precipitation of solids both because the amount of water is decreased and because dissolved $CO_2$ is removed by gas sweeping as steam escapes. If, however, the methane pressure is maintained high enough so that the total pressure is over 65 psia, then the 300-degree brine cannot boil and steam removal is greatly reduced. As a corollary little dissolved $CO_2$ escapes and the brine concentrations are not altered so the solutions remain stable and solids do not precipitate. Furthermore, violent ejections of brine will be largely controlled if boiling is prevented. If, for example, the gas pressure is maintained at 100 psia, then over 99% of the dissolved methane can be released, and the gas released at 300° F. from one bbl of brine will consist of 65 psia of steam plus 35 psia of methane jointly making up 100 psia of gas pressure in a total volume of 16 cu ft. In this case less than 0.01% of the brine boils away and no important precipitation of solids occurs. However, the volume of the fluid is essentially quadrupled (5.6 cu ft per bbl of brine to 21.6 cu ft for brine plus gas), and the gas volume at 100 psia is available to pump a third as much brine volume at 300 psia for circulation and injection of spent brine. In this case the brine can be withdrawn from a hot region, circulated through a methane stripper, and reinjected into a slightly different region. Because the formation is porous and the pressure is hydrostatic, brine will flow to equalize pressures rapidly, and there will be no subsidence.

Now consider a geopressured formation in which the pressure is partly hydrostatic at about 0.465 psia per ft of depth and partly lithostatic at about 1 psia per ft of depth. The well is 15,200 ft deep, the temperature is 300° F. at the bottom of the hole, the BHP is 12,000 psia, and there is a methane solubility of 60 SCF per bbl. Release of this methane can produce 25 cu ft of methane plus steam at 100 psia. This gas volume at 100 psia can move the brine volume at about 450 psia. If the brines are stripped of their methane and then reinjected in to the same geopressured formation but at a remote region, so that removal and reinjection are hydraulically linked, then large regions of the formation can be made available for methane recovery while the chance of serious subsidence is much reduced. This opportunity for limiting subsidence in geopressured regions by reinjection of the spent brine back into its original formation is solved by this invention.

To prevent collapse of the wellpipes, it is necessary to design the system so that the high pressure differences between the formation pressure and the pressure of the product methane do not act against the wellpipe.

Because cooling the saturated brines can lead to precipitation of solids, the cooling should be minimized, thus the methane is extracted in the hot regions of the wellpipe rather than where ocean or ground water has cooled it.

2. Prior Art

A. "Method and Devices for In Situ Recovery of Gaseous Hydrocarbons and Steam," by G. R. B. Elliott, N. E. Vanderborough, and M. W. McDaniel, Patent application Ser. No. 15,360, filed Feb. 26, 1979. This patent application recognizes the value of recovering in situ energy to assist in the reinjection of spent brine after methane removal, and it points out the value of recovering the methane without ever bringing brine to the ocean or earth surface. It does not disclose that the release of dissolved methane can suppress solids precipitation from steam vaporization while supplying nearly all of the energy needed to circulate the brine.

B. "The Status of Dissolved Gas in Japan," by S. S. Marsden, in Petroleum Engineer, June 1980, pp. 23–34. This paper describes the Japanese production of methane from methane-containing brines which involves pumping brine to surface facilities where methane is stripped out. The pumps are not self-powered, and no deep, hot wells are involved; rather, the wells are typically at 1,500–3,000 feet depths with 6,000 feet being maximum depth.

C. U.S. Pat. No. 4,149,598 (4/79) and 4,149,596 by Christian et al. These patents show that methane can be recovered from aquifiers which are hydrostatically pressured and in this recovery, large quantities of brine are lifted to the surface by pumping from the surface. The pumping causes a pressure drop in the brine near the wellpipe and, so long as pumping is continued, dissolved methane can be released to a gas phase. If pumping is stopped, the pressure of the brine will again rise to the hydrostatic pressure head, and gas evolution will cease. The Christian patents do not recognize the value of using the expansion of the methane upon pressure release to drive the pumping necessary to circulate virgin brine into position for methane release, and the serious problem of disposing of the spent brine which is brought to the surface.

D. U.S. Pat. No. 3,782,468 by Kuwada. This work identifies that the evaporation of brine to steam can cause the circulation of hot brine to the surface for processing, and injection of $CO_2$ is described to suppress the precipitation of carbonates and hydroxides which could form as steam release swept $CO_2$ out of solution.

E. U.S. Pat. No. 4,131,161 by Lacquement. This patent describes the use of a standpipe inside a wellpipe to circulate brine and recover dry steam from deep, hot wells. This patent uses in situ forces to achieve the pumping to circulate brine, and all the steam recovery facilities are below ground. The work does not address serious limitations imposed on the invention if steam is released from hot, saturated brine, i.e., geyserlike ejection of brine up the wellpipe and precipitation of solids with wellpipe plugging.

F. "Petroleum Production Handbook," Editors T. C. Frick and R. W. Taylor, Chapter 6, "Hydraulic Pumps," by C. J. Coberly and F. B. Brown, and Chapter 31, "Wellbore Hydraulics," by J. K. Welchon, A. F. Bertuzzi, and F. H. Poettman. These chapters indicate the pumping and gaslift concepts which are used in oil and gas production.

OBJECTS OF THE INVENTION

It is an object of this invention to strip methane economically and environmentally safely from hot brine at downhole depth and inject the depleted brine immediately into a formation penetrated by the wellpipe.

It is another object of this invention to use in situ forces to circulate the brine.

It is a further object of this invention to use downhole pumps or turbines powered by in situ forces to circulate the brine and suppress steam vaporization and precipitation of solids.

Other objects, advantages and novel features of this invention will be apparent to those of ordinary skill in the art upon examination of the following detailed description of a preferred embodiment of the invention and the accompanying drawings.

SUMMARY OF THE INVENTION

A method and device for circulating hot, natural brine and recovering methane is described. This circulation is driven partially or completely by in situ forces, once initial pumping has started the device. The device can operate without moving parts, but more efficient operation can be accomplished if the system uses pumps powered by in situ forces. The principle driving force is the expansion of methane after the hydrostatic pressure on a deep brine has been released. The gas which is released suppresses harmful steam vaporization, it lifts brine to a standpipe, it forces spent brine from standpipes and into disposal formations, and it powers pumps or turbines for brine circulation and disposal. When mechanical pumps or turbines are used, several pumps or turbines can be operated at different depths in the wellpipe to recover natural gas from different portions of the methane-containing brine.

DESCRIPTION OF PREFERRED EMBODIMENTS

Figure 1:
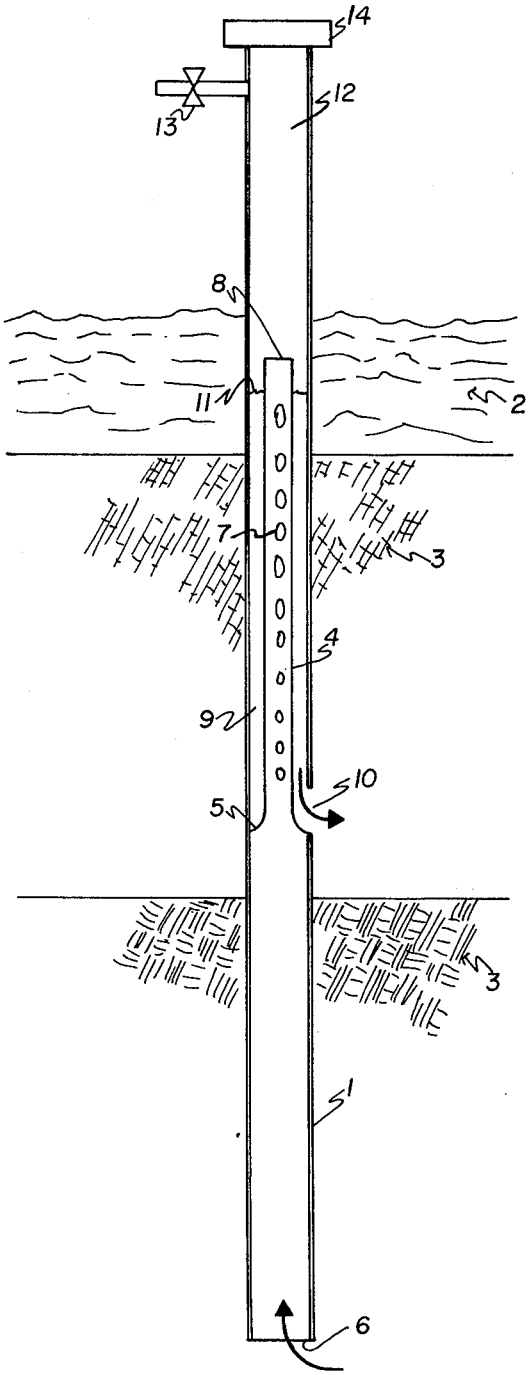
FIG. 1 shows a schematic drawing of a recovery device for the brine circulation and recovery of natural gas.

In FIG. 1 a wellpipe 1 penetrates an ocean 2 and deep, sedimentary strata 3. Within the wellpipe 1 there is an inner pipe 4 which forms a joint 5 to the wellpipe 1 at some convenient depth. Inner pipe 4 is used to establish four regions within the wellpipe. In the first region virgin brine containing dissolved methane flows into the bottom 6 of the wellpipe and moves up the wellpipe 1. Filters and well perforations of customary design (not shown) are used to increase the brine flow and remove solids. As the virgin brine moves up the wellpipe, the pressure head from the column of fluid is reduced, and some small methane bubbles form. As the methane-containing brine rises and moves into the inner pipe 4, the bubbles become larger and significantly affect the amount of brine which can be held in the inner pipe 4 to make up the pressure head. This region of bubbly brine 7 ends where brine spills out of the top 8 of the inner pipe 4. A region of relatively bubble free brine 9 circulates out of the wellpipe 1 at perforations 10, and brine in the porous formations moves to equalize the pressure inhomogeneities created within the formations by the brine circulation. The circulation rate of the brine reflects a number of factors including the height 11 of the brine column between the inner pipe 4 and the wellpipe 1, the difference in pressure heads from the top 8 of the bubbly-brine 7 and the top 11 of the bubble free brine 9, the permeability of the formations, and the pressure exerted by the natural gas in the upper region 12 of the wellpipe. This gas pressure is maintained higher than the pressure of saturated steam over the brine; for brine at 300° F., this gas pressure is greater than about 65 psia which is the saturated pressure of steam over pure water in that temperature. The height of the bubble free brine 11 will find a location which balances the production of virgin brine at the bottom 6 of the wellpipe 1 and the reinjection of spent brine at the perforations 10. The height 11 can be above or below the top 8 of the inner pipe 4. The condition for steady-state production of brine and recovery of natural gas involves a pressure of bubbly brine 7 plus gas 12 which is less than the hydrostatic pressure or geopressure of the formation at the bottom 6 while the pressure of bubble free brine 9 plus gas 12 is sufficient to overcome the formation pressure at the discharge perforations 10. These pressures exist because the release of gas bubbles from the virgin brine acts as a gas lift for the upward-moving brine, and the expansion of the released gas lifts the brine to a higher height 11 than it would rise against the ambient gas pressure 12 if the gas lift were not taking place. Natural gas product is delivered through release valve 13 at about the operating pressure which was selected to suppress steam vaporization and reduce solid precipitation. However, some solid precipitation will occur because of cooling of the hot brine as it moves up the lower portion of wellpipe 1 and through the inner pipe 4. Therefore, means must be provided to remove this solid after important amounts of it have built up inside the wellpipe 1 and inner pipe 4. This means is provided by a cap 14 on the wellpipe 1 which provides for insertion of scrapers, reamers, scouring solutions, etc., which will remove the built-up deposits. In addition, the cap 14 provides means to introduce and attach a priming system to start circulation.

Figure 2:
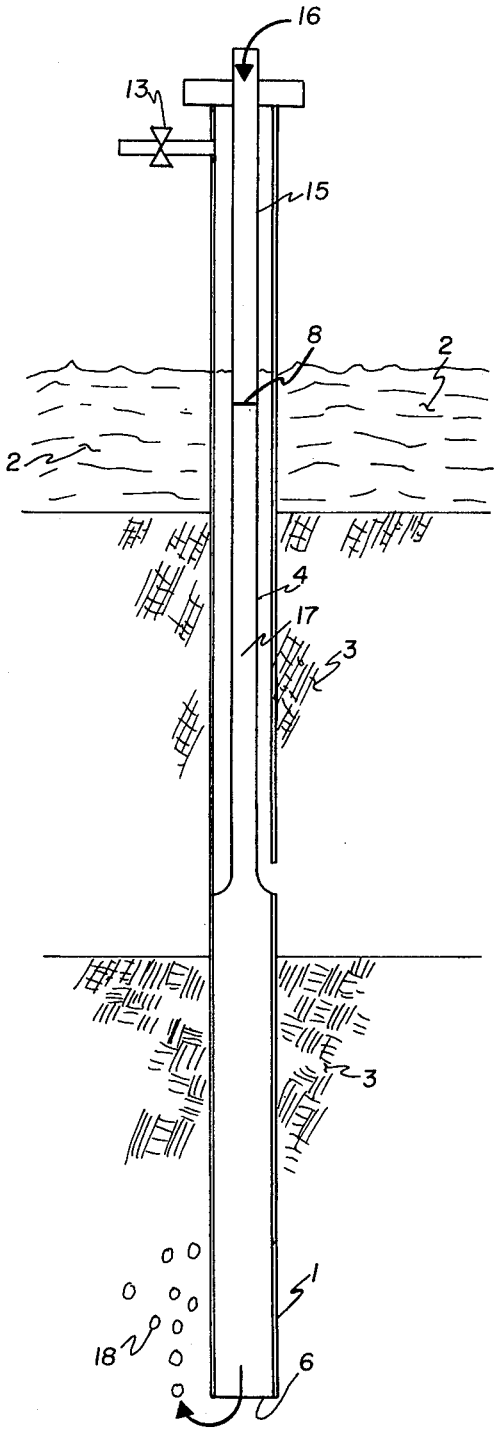
FIG. 2 shows a schematic drawing of the starting mechanism for the brine circulation and recovery system.

In FIG. 2 a startup pipe 15 is introduced through cap 14 and attached to inner pipe 4 at its top 8. Gas is blown into the startup pipe 16 displacing the brine with gas 17 throughout the inner pipe 4 and the lower portion of the wellpipe 1. Bubbles 18 flow into the surrounding formation 3 when the brine level has dropped to the bottom 6 of the wellpipe 1. To initiate circulation, the startup pipe 15 is lifted or removed, and the gas pressure is released, permitting methane-containing brine to rise in the lower wellpipe 1 and inner pipe 4, meanwhile releasing methane, and causing circulation to achieve steady state by adjusting itself to ambient conditions. Circulation can be halted at any time by slowly releasing the internal gas pressure to atmospheric through release valve 13. Under these conditions the gas lift is destroyed, and the original quiescent conditions are achieved downhole. If the wellpipe is broken off by some accident, the uncontrolled release and ejection of brine will locally deplete the brine around the bottom 6 of the wellpipe 1 and halt the flow. For hydrostatically pressured brines the flow of cold brine into the wellpipe will quench the self-powered circulation.

Figure 3:
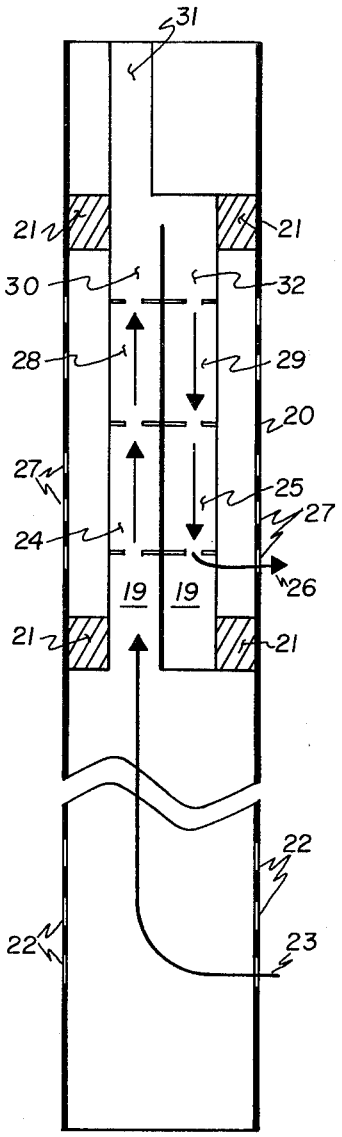
FIG. 3 shows the essential elements of a self-powered, piston-driven, pumping system for circulating brine and removing dissolved methane while suppressing steam vaporization and precipitation of solids.

In FIG. 3 a self-powered, piston-driven, pumping system 19 is emplaced in a wellpipe 20, being attached by top and bottom seals 21. Perforations 22 in the lower section of the wellpipe 20 permit virgin brine 23, at hydrostatic pressure (or geopressured) and containing dissolved methane, to flow into the pumping system 19. A first pump 24 is connected to a second pump 25 and, because the cylinders and pistons in each pump are similar, each pump will pass equal volumes of liquid. Pump 24 permits entry of virgin brine into the pumping system 19 while the second pump 25 moves methane-free, spent brine 26 through perforations 27 in the wellpipe 20 into the disposal region of the briny formation. The work obtained by decompression of virgin brine essentially equals the work of recompression required to inject spent brine into the disposal formation. In the pumping system of this invention, most or all of the work necessary to overcome friction is derived through the release of methane and limited amounts of steam and the expansion of this gas against a piston in a third pump region 28. By conventional techniques (not shown) additional work could be done by the use of pressurized fluids delivered from the surface to the down hole pumps or by electric motors powered from the surface. Also, work can be done if geopressured brines are delivered to the pumps and the brine is injected into hydrostatically pressured regions. The work of the gas expansion in third pump 28 applies pumping pressure to spent brine in a fourth pump 29 which supplies spent brine to the injection pump 25 from which it moves to the disposal region of the formation. After the methane has been largely released from the brine by third pump 28, the methane and spent brine move into region 30 where the gas moves up to the surface through pipe 31 and the spent brine moves to region 32 which is a reservoir for pumps 29 and 25. The walls of the pumping system 19 and the methane delivery pipe 31 must be capable of sustaining crushing pressures of several thousand psia because outside pressures (in this example) are about 7000 psia as at regions beside the wellpipe and are about 100 psia at regions 30, 31, and 32. The circulation of virgin brine is started by pumping gas into the methane-delivery pipe 31 and displacing brine out of the system. Likewise circulation can be started by auxiliary power from the surface. The circulation can be stopped by pouring brine into the methane delivery pipe 31.

Figure 4:
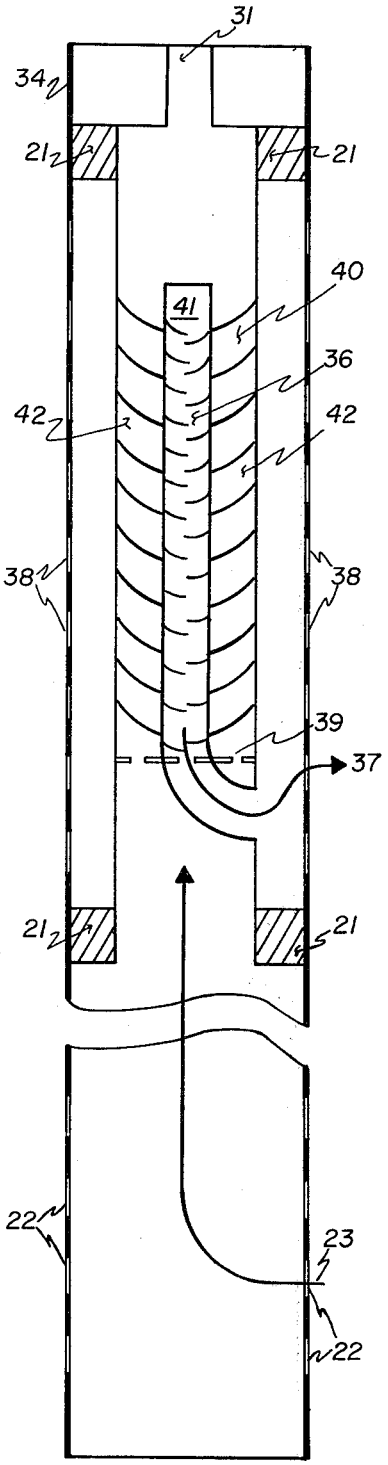
FIG. 4 shows essential elements of a self-powered, turbine-driven, pumping system for circulating brine and removing dissolved methane.

In FIG. 4 a coupled, double turbine 41 with outer section 42 is driven by virgin brine 23 which moves into the wellpipe 34 from entrance perforations 22. The inner section 36 of the turbine 41 pumps methane-free spent brine 37 into a disposal formation through perforations 38. The pressure in the outer section 42 of the turbine 41 drops from formation pressure of about 7000 psia in this example at the bottom 39 of the turbine 41 to a methane release pressure of about 100 psia in this example at the top 40 of the outer section 42. Expansion of methane and small amounts of steam takes place in the outer section 42 of the turbine 41, but the corresponding pumping for injection of the spent brine into the disposal formation involves only a trivial compression of the brine, and even this work of compression is balanced in release of the virgin brine. Therefore, the spent brine can be pumped from about 100 psia to about 7000 psia with minimal work, and the fluid release of the virgin brine is able to do enough work to overcome the frictional losses in the turbines and in the flow in the formation. Released methane moves to recovery through the methane delivery pipe 31. The double turbine 41 is sealed into the wellpipe 34 by top and bottom seals 21. The pumping system must withstand a pressure drop of about 7000 psia between the formation pressure and the pressure at which the methane is delivered to the surface. Additional power can be supplied from the surface. The circulation is started either by pumping gas into the methane-delivery pipe 31 and displacing brine out of the system or by operating the pumps from surface power. Circulation is stopped by pouring brine into the methane-delivery pipe 31.

Figure 5:
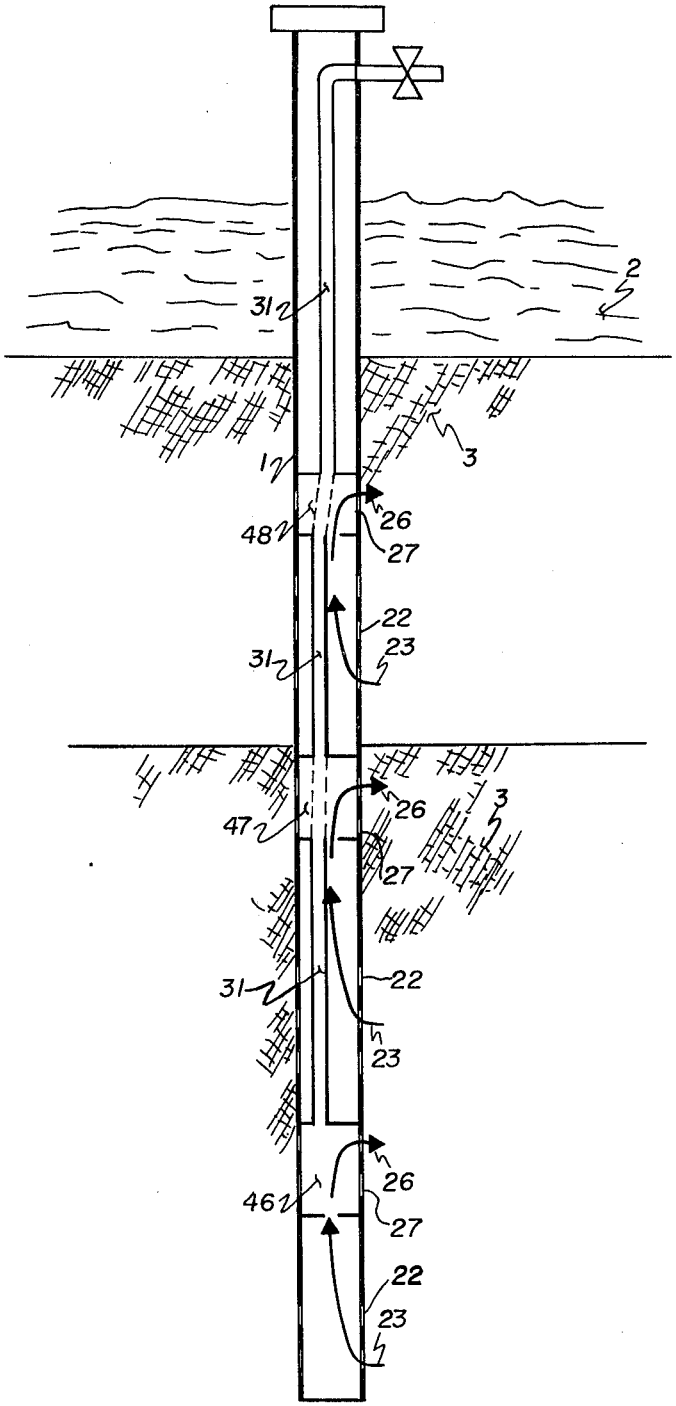
FIG. 5 shows three pumping systems as shown in FIG. 3 in different regions of a wellpipe operating simultaneously to remove methane from solution.

In FIG. 5 is shown the multiple use of pumping systems 46, 47, 48 of the type described in FIGS. 3 or 4 in which a wellpipe 1 penetrates a section of ocean 2 and methane-containing formations 3. Lower 46, middle 47, and upper 48 pumping systems are each independently accepting virgin brine 23 through perforations 22 and independently delivering spent brine through perforations 27 to disposal, while supplying methane to a common delivery pipe moving gas to the surface at low pressure relative to the adjacent formation pressure. The methane pressure is set by pipe sizes and delivery rates, but it is low enought to release most of the methane from the virgin brine while suppressing the steam vaporization and delivering an adequate supply of methane to the surface.

The foregoing description of a preferred embodiment of the invention has been presented for purposes of illustration and description and is not intended to be exhaustive or to limit the invention to the precise form disclosed. It was chosen and described in order to best explain the principles of the invention and their practical application to thereby enable others skilled in the art to best utilize the invention in various embodiments and with various modifications as are suited to the particular use contemplated. It is intended that the scope of the invention be defined by the claims appended hereto.

What is claimed is:

1. A method of recovering natural gas from solution in hot brines in which circulation of the brine and recovery of the dissolved natural gas is powered by the expansion of natural gas released from solution in the brine comprising: (a) injecting a gas into a wellpipe to displace brine, (b) releasing the injected gas, (c) allowing methane-containing brine to flow into a pumping system thereby releasing the natural gas, (d) maintaining a pressure of natural gas greater than the vapor pressure of saturated steam over the brine at formation temperature, and (e) injecting the spent brine back into a formation.

2. The method of claim 1 in which solids precipitated by cooling of methane-containing brines are removed through a cap at the top of the wellpipe that allow ready access to the precipitated solids.

3. The method of claim 1 in which circulation in the said pumping system is stopped by slow release of methane out of the wellpipe.

4. The method of claim 1 in which the said pumping system comprises two or more coupled pumps of turbines operating within a wellpipe simultaneously, and (a) accepting steam-saturated, methane-containing brine from a porous, subsurface formation, (b) using the said brine as a working fluid in a first pump or turbine, (c) expanding the fluid by releasing dissolved natural gas, (d) causing the expanding fluid to supply all or a portion of the work required to operate a second pump or turbine which reinjects the spent brine into a disposal formation, and (e) delivering the released gas to the surface for recovery.

5. The method of claim 4 in which two or more pumping systems of coupled pumps or turbines are operated simultaneously, with each system being independently fed methane-containing brine from different regions adjacent to a single wellpipe.

6. The method of claim 4 in which circulation in the said pumping system is stopped by adding brine to the gas delivery pipe.

7. The method of claim 4 in which the coupled pumps of turbines injecting the spent brine back into the formation are driven by the release of gas in the geopressured brine.

* * * * *